US005350494A

United States Patent [19]

Brummelhuis

[11] Patent Number: 5,350,494

[45] Date of Patent: Sep. 27, 1994

[54] ARRANGEMENT FOR CATHODIC PROTECTION

[76] Inventor: Franciscus Brummelhuis, De Peppelaar 22, 7491 DK Delden, Netherlands

[21] Appl. No.: 42,575

[22] Filed: Apr. 5, 1993

[30] Foreign Application Priority Data

Apr. 7, 1992 [NL] Netherlands ..... 9200653

[51] Int. Cl.[5] ..... C23F 13/00

[52] U.S. Cl. ..... 204/197; 204/196; 204/148

[58] Field of Search ..... 204/148, 197, 196

[56] References Cited

U.S. PATENT DOCUMENTS

| | | | |
|---|---|---|---|
| 2,903,405 | 9/1959 | Sabins | 204/197 |
| 3,142,631 | 7/1964 | Woodley | 204/196 |
| 3,330,751 | 7/1967 | Warner | 204/196 |
| 3,360,452 | 12/1967 | McNulty | 204/197 |
| 3,362,900 | 1/1968 | Sabins | 204/196 |
| 3,959,664 | 5/1976 | Kosoegawa | 204/196 |

*Primary Examiner*—John Niebling
*Assistant Examiner*—Kishor Mayekar
*Attorney, Agent, or Firm*—Oblon, Spivak, McClelland, Maier & Neustadt

[57] ABSTRACT

Arrangement for cathodic protection from corrosion of metal bodies surrounded by an electrolytic medium, comprising a metal anode body which is to be introduced into the medium and has a lower (electric) quiescent potential in the medium than the bodies to be protected, where, by means of circuit comprising at least Schottky diode operating above a certain threshold voltage, one of the bodies to be protected and another one of the bodies to be protected have a difference in potential which is at least equal to the threshold voltage, but smaller than the quiescent-potential differences of the two bodies.

16 Claims, 4 Drawing Sheets

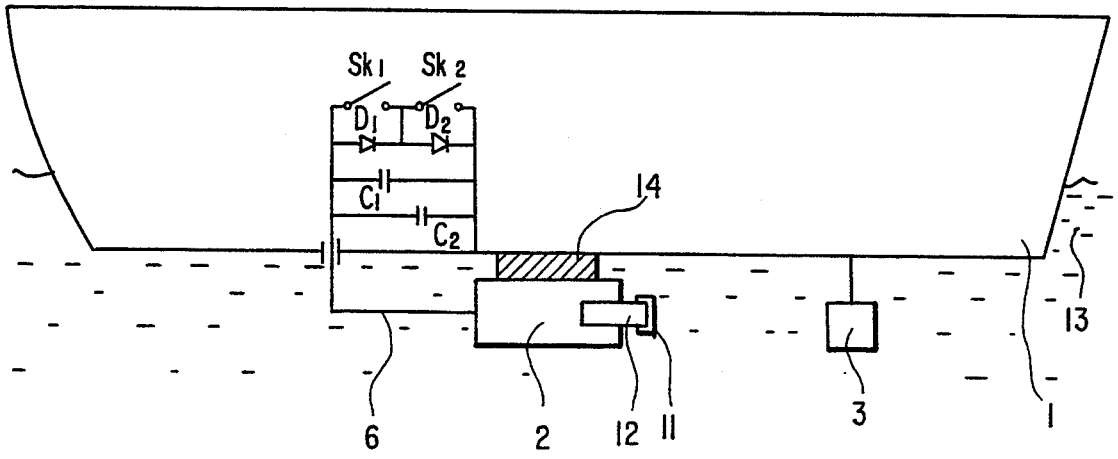
FIG. 7
FIG. 8
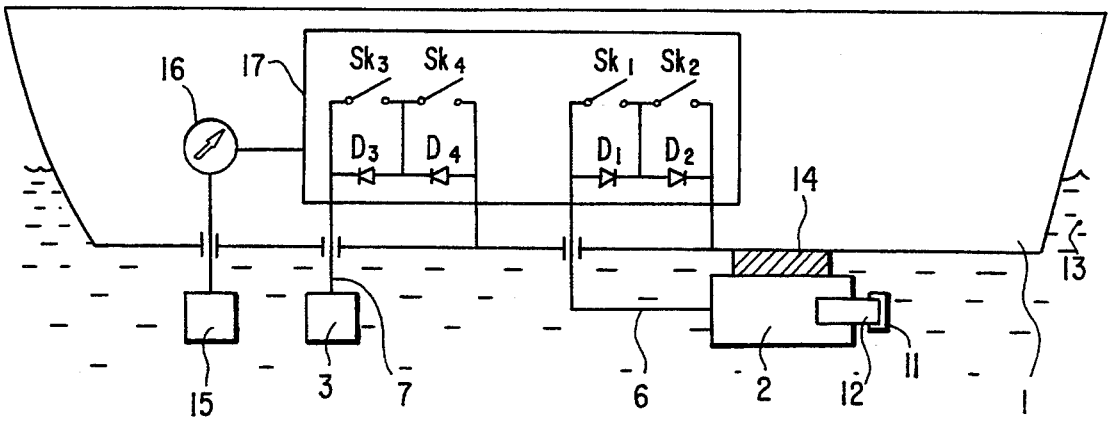

ARRANGEMENT FOR CATHODIC PROTECTION

BACKGROUND OF THE INVENTION

In itself, cathodic corrosion protection of a metal body, such as a ship's hull, surrounded by an electrolytic medium, such as seawater, by means of a metal anode having a lower quiescent potential, such as a sacrificial zinc electrode, is known. When a zinc anode is used for the protection of a coated steel ship's skin, this anode is, for example, electrically short-circuited with the ship's skin. With the known zinc anode, corrosion of a body made of a certain type of metal can often be inhibited in an adequate manner.

Besides this cathodic protection by means of a sacrificial electrode, which is known as a passive protection, there is a form of active protection according to which an anode is placed in the vicinity of the metal body to be protected and this anode is subsequently kept at such a potential that oxidizing reactions on the surface of the body to be protected are prevented.

A disadvantage of the known arrangements for cathodic protection is that they often promote disbonding of a synthetic or plastic coating applied to a body to be protected. It is known that such disbonding can be caused by hydroxide ions produced in cathodic reactions on the surface of the body to be protected.

In numerous practical situations there is a need for an arrangement for cathodic protection where any disbonding of a plastic attached to a metal to be protected does not occur. Moreover, in numerous practical situations there is a need for an arrangement for cathodic protection of a body comprising several types of metal which have different quiescent potentials in a particular medium. Sea-going vessels of which the hulls are made of a carbon steel are sometimes provided with specific underwater equipment. Such equipment is often accommodated in a stainless-steel housing which is necessarily provided with sealing interfaces to a synthetic material (plastic).

When such underwater equipment is freely exposed in seawater, various types of corrosion may occur, with especially crevice corrosion posing a threat to the equipment. Crevice corrosion is a form of local attack occurring as a result of differences in the oxygen content of the electrolytic medium, seawater in the present case, in crevices and cracks in regard to the medium at the greater part of the stainless-steel surface. In the crevice, a depletion of oxygen takes place and the protective oxide film built up in normal conditions and existing on the stainless steel is broken down locally in the crevice, while, in addition to this, a galvanic action takes place between the crevice and the remaining part of the stainless-steel surface. In the crevice, the pH becomes lower and lower by the release of $H^+$-ions, resulting in an increasingly fast progressing attack. Crevice corrosion may result in leakage.

I have found that an effective cathodic protection from corrosion of such a stainless-steel housing with sealing interfaces to a plastic material is not feasible by making use of a known arrangement. Especially, the development of disbonding of a plastic attached to stainless steel presents a problem.

The present invention relates to an arrangement for cathodic protection from corrosion of a metal body surrounded by an electrolytic medium, comprising a metal anode body which is to be introduced into the medium and has a lower (electric) quiescent potential in the medium than the body to be protected. The quiescent potential of a metal body surrounded by an electrolytic medium is understood to mean the potential of a body freely exposed in this medium, that is to say that the body is not part of an electric circuit: The value of the quiescent potential is usually stated with regard to a certain reference electrode.

SUMMARY OF THE INVENTION

According to the present invention, there is now provided an arrangement as described in the preceding paragraph, where, by means of a circuit comprising at least a rectifier device operating above a certain threshold voltage, the body to be protected and the anode body are electrically interconnected such that there is provided a difference in potential between the anode body and the body to be protected which is at least equal to the threshold voltage, but smaller than the quiescent-potential difference of the body to be protected and the anode body.

According to the invention, the electric interconnection of the anode body and the body to be protected gives rise to a galvanic couple whose anode current is determined by the value of an equilibrium potential to be set for this cell, which potential is determined by values of the quiescent potentials of the individual bodies to be protected and the anode body, by the rate at which the cathodic and anodic reactions on the metal surfaces of the various metals take place, by the available surface area of the individual metals, and by the electric resistances between the respective metals. The rates of the cathodic and anodic reactions on the surfaces of the various metals is co-dependent upon the condition of the electrolytic medium (e.g., salt content, oxygen content, temperature and flow rate of seawater). According to the invention, by electrically interconnecting the anode body and the body to be protected, by means of a circuit comprising, in between two of the bodies connected, at least one rectifier device operating above a certain threshold voltage, with the threshold voltage being lower than the difference in quiescent voltage of the relevant two bodies connected, a constant potential difference between these two bodies is provided and that current does not depend upon the intensity of the current passing through the rectifier device. I have found that the occurrence of undesirable phenomena, such as disbonding, is inhibited by limiting the potential difference which might develop between two metal bodies. The parameters of the rectifier device to be applied are determined by the metal dimensions and properties of the bodies to be protected and the anode to be used, and by the properties of the medium surrounding the bodies. A rectifier suitable for application according to the invention has such a threshold voltage that the potential difference between two bodies connected through this rectifier device is reduced when a current flows through the rectifier device, whereas the potential reduction is not so large that a body which is to be protected and is connected with the rectifier device becomes subject to anodic reactions.

Furthermore, the present invention also relates to an arrangement for cathodic protection from corrosion of at least two metal bodies surrounded by an electrolytic medium, with a first body of these having a lower quiescent potential in the medium than a second body has, comprising a metal anode body which is to be introduced into the medium and has a lower quiescent potential in the medium than said first body, with the anode body and the bodies to be protected being electrically interconnected by means of a circuit comprising, in between two of the bodies connected, at least one rectifier device operating above a certain threshold voltage, such that between the bodies connected there is a potential difference which is at least equal to said threshold voltage, but is smaller than the difference in quiescent potential of the relevant two bodies connected.

An exemplary embodiment of an arrangement according to the invention is characterized in that the first body is connected with the anode body through a conductor or electric circuit including the rectifier device and the second body is, in direct electrical contact, connected with the first body.

Another exemplary embodiment is characterized in that the first body is, in direct electrical contact, connected with the anode body and the second body is connected with the first body through a conductor or electric circuit including the rectifier device.

Still another exemplary embodiment is characterized in that the first body is connected with the anode body through a first conductor or electric circuit including a first rectifier device, and the second body is connected with the first body through a second conductor or electric circuit including a second rectifier device.

A further exemplary embodiment is characterized in that the first body is connected with the anode body through a conductor or electric circuit including the rectifier device and the second body is, in direct electrical contact, connected with the anode body.

A further exemplary embodiment is characterized in that the first body is, in direct electrical contact, connected with the anode body and the second body is connected with the anode body through a conductor or electric circuit including the rectifier device.

A further exemplary embodiment is characterized in that the first body is connected with the anode body through a first conductor or electric circuit including a first rectifier device and the second body is connected with the anode body through a second conductor or electric circuit including a second rectifier device.

According to the invention, the rectifier device comprises, e.g., a diode, or a transistor whose base is "wire-connected" with its collector or its emitter, depending on the transistor type concerned.

The rectifier device is preferably a Schottky diode whose forward direction corresponds with the difference in quiescent potential of the bodies connected through this diode.

I have been found that on account of its steep current-voltage characteristic in the conducting-state region and its comparatively low threshold voltage (in the order of 100–400 mV) a Schottky diode is pre-eminently suitable for reducing, to a considerable extent and in a controllable manner, differences in voltages between a zinc anode and a metal body to be protected, which is made of, e.g., stainless steel, when both of them are surrounded by seawater.

In an arrangement for cathodic protection of metal bodies, e.g. a first body made of a carbon steel and a second body made of a stainless steel, surrounded by an electrolytic medium, such as salt water, especially seawater, comprising an anode body, e.g. made of zinc, which is to be introduced into this medium and is, through a circuit, electrically interconnected with the bodies to be protected, the first body is preferably, in direct electrical contact, connected with the anode body, and the second body is connected with the first body through a conductor or electric circuit including a Schottky diode whose forward direction corresponds with the difference in quiescent potential of the second and first body.

It has been found that the inhibition of corrosion is optimal in such an arrangement wherein a carbon-steel first body and a stainless-steel second body are cathodically protected by means of a zinc anode. A major part of the potential difference between the zinc anode and the stainless-steel body which occurs in seawater is bridged by the electric connection of the stainless-steel body via the Schottky diode to the stainless-steel body, as a result of which the cathode currents on the stainless-steel body are reduced.

With an arrangement according to the invention it is feasible to reduce the material consumption by a sacrificial anode (e.g., a magnesium, zinc or aluminium anode) considerably as compared with the material consumption in known arrangements. In addition, the arrangement is especially suitable for inhibiting the disbonding of plastic-metal connections or plastic coatings on a metal in an electrolytic medium. Since, in an arrangement according to the invention, it is possible to counter effectively the disbonding of coatings on a metal surface, the invention makes it feasible to apply types of paint and other coating materials which have been unsuitable up to now, but which are possibly preferable on account of economic or environmental considerations.

The invention relates to both arrangements for passive cathodic protection and arrangements for active cathodic protection.

With an arrangement according to the invention it is possible to provide both active and passive protection of a body surrounded by an electrolytic medium, even if this body includes a plurality of metal components having different quiescent potentials and/or is provided with sealing plastic attachments or coatings.

An arrangement according to the invention is advantageously organized such that it can be continuously adjusted to the actual conditions, such as the temperature, salinity, and oxygen content of seawater, in which the body to be protected is.

BRIEF DESCRIPTION OF THE DRAWINGS

Hereinafter the invention will be further explained by means of exemplary embodiments with reference to the drawing.

In the drawing,

FIGS. 7 and 8 show sketches of a few examples of applications of an arrangement.

DETAILED DESCRIPTION OF THE INVENTION

Figure 1:
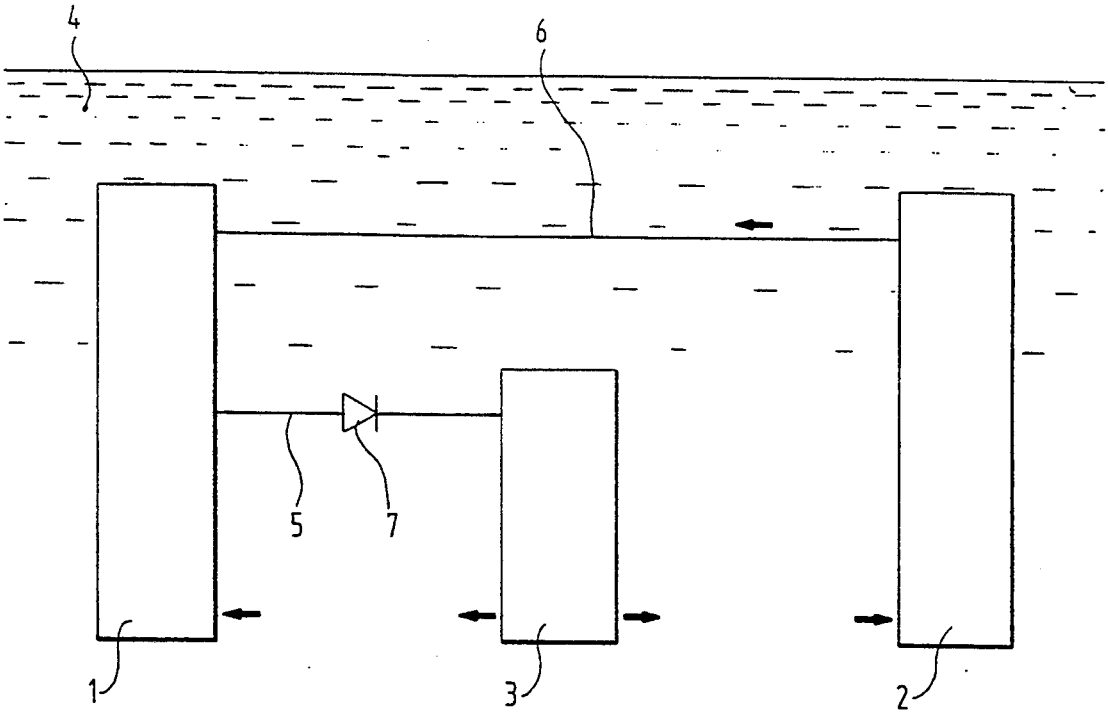
FIGS. 1 through 6 show different exemplary embodiments of an arrangement for cathodic protection of two metal bodies which are surrounded by an electrolytic medium and have different quiescent potentials in this medium, using a sacrificial anode.

FIGS. 1 through 6 depict a first body 1 surrounded by an electrolytic medium 4, a second body 2 and an anode body 3, with the first body 1 having a lower quiescent potential than the second body 2, and the anode 3 having a lower quiescent potential than the first body 1 has.

Figure 2:
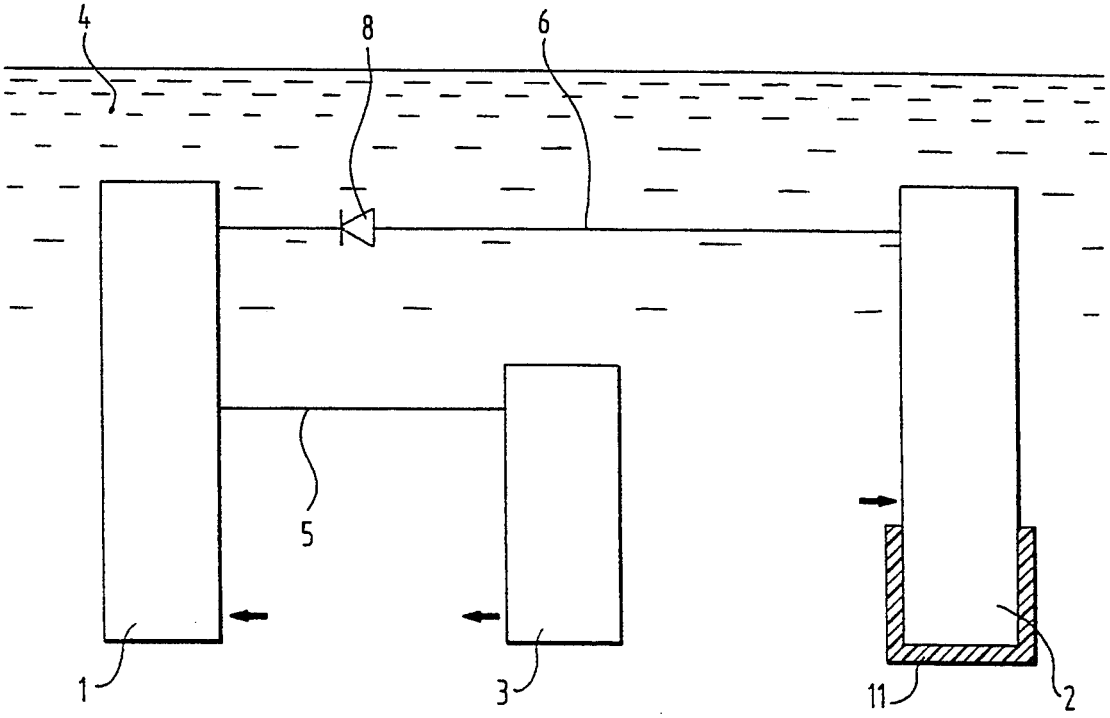
Figure 3:
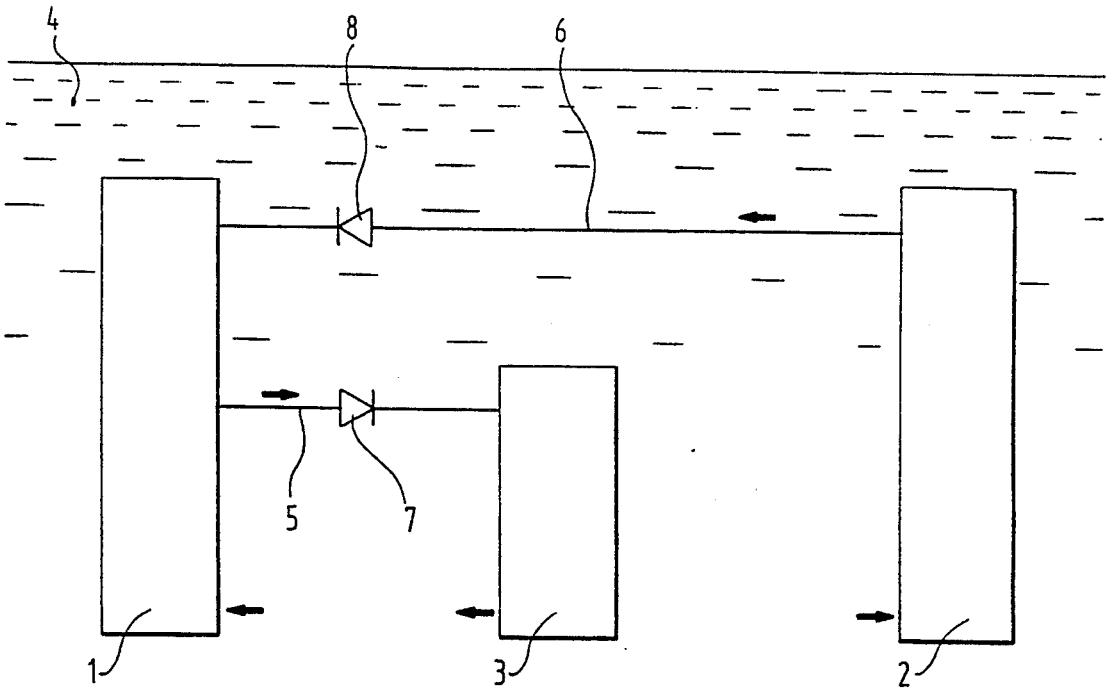

In FIGS. 1 through 3, the second body 2 is electrically connected with the first body 1 through a line 6, while the first body 1 is connected with the anode 3 through a line 5. In FIG. 1, the first body 1 is connected with the anode 3 through a diode 7; in FIG. 2 the second body 2 is connected with the first body 1 through a diode 8; and, in FIG. 3, the second body 2 is connected with the first body 1 through a diode 8, and the first body 1 is connected with an anode 3 through a diode 7. The arrows in FIGS. 1 through 3 represent the existing current directions, schematically.

Figure 4:
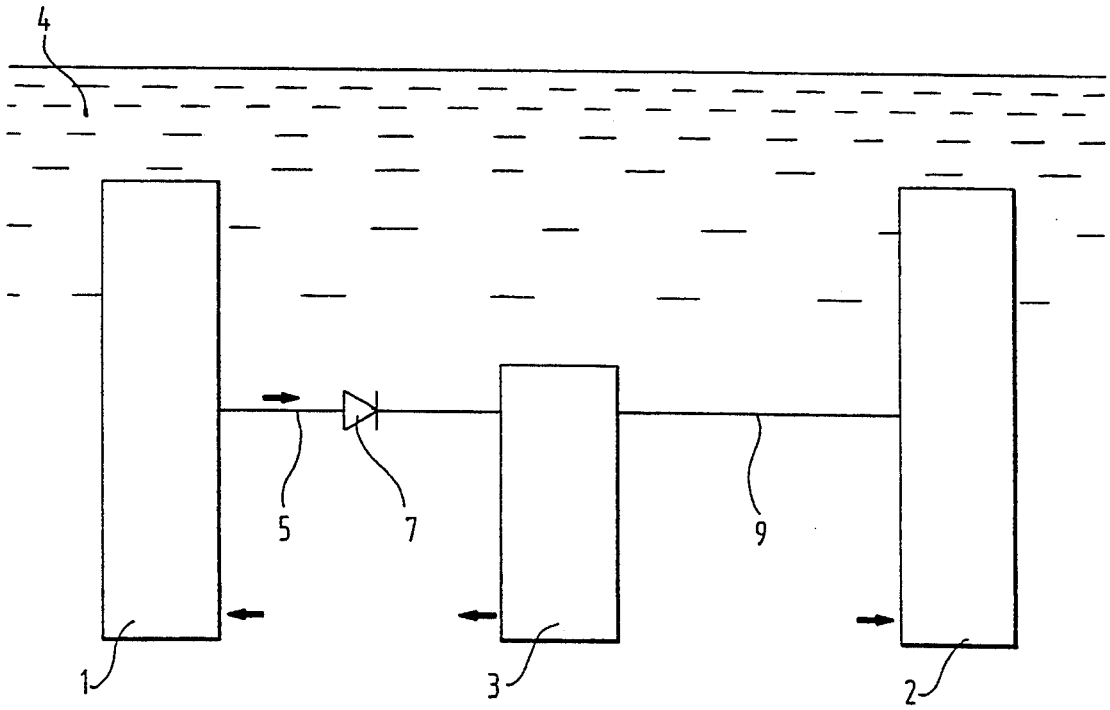
Figure 5:
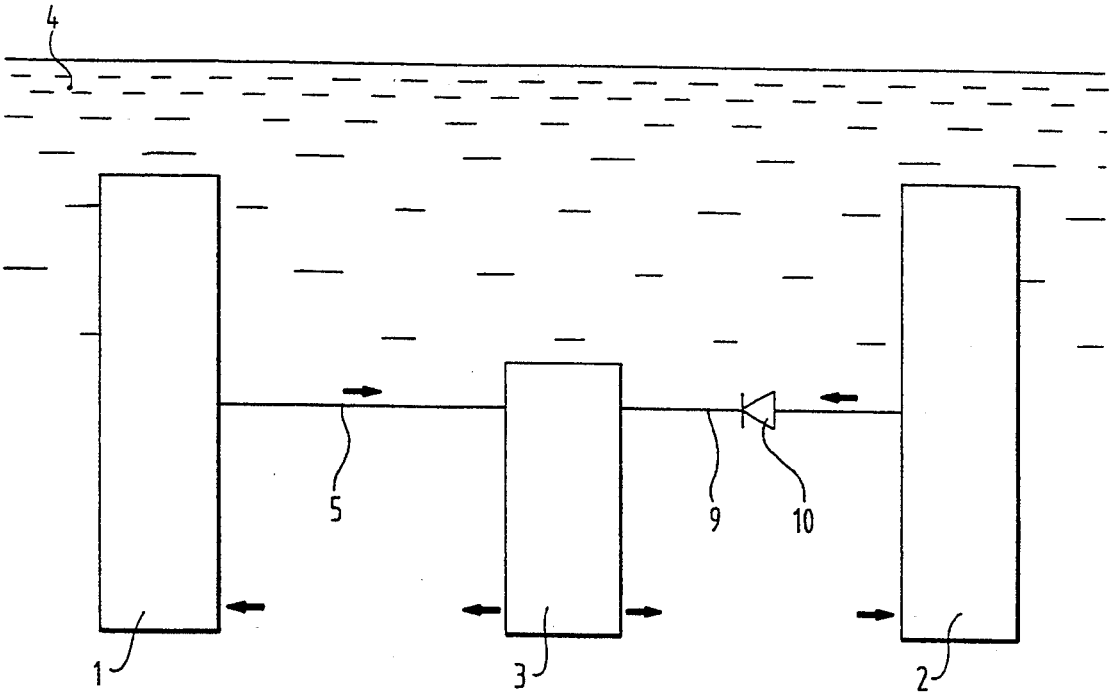
Figure 6:
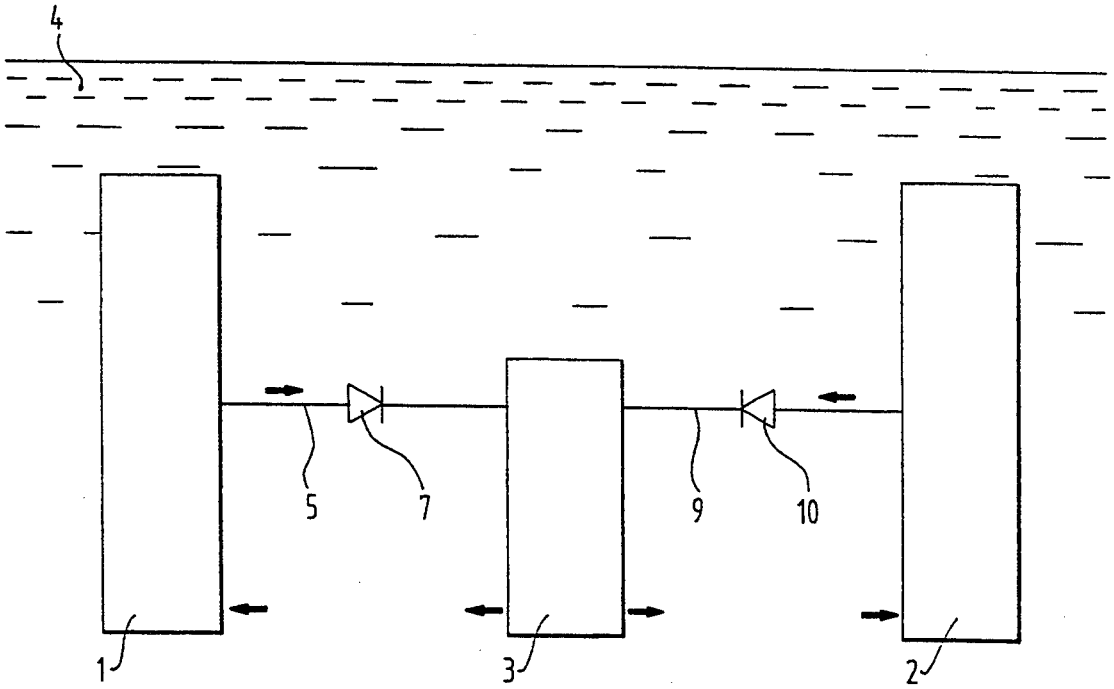

In FIGS. 4 through 6, the first body 1 and the second body 2 are separately (electrically) connected by means of a line 5 and a line 9, respectively. In FIG. 4, the first body 1 is connected with the anode 3 through a diode 7. In FIG. 5, the second body 2 is connected with the anode 3 through a diode 10; and in FIG. 6, the first body 1 and the second body 2 are connected with the anode 3 through the diodes 7 and 10 respectively. Again, the arrows represent the existing currents symbolically.

Furthermore, FIG. 2 shows a coating 11 around a portion of the second body 2. It has been found that an arrangement according to the embodiment of FIG. 2, in which, e.g., the first body 1 is made of a carbon steel and the second body 2 is made of a stainless steel to which a plastic coat 11 is attached, the anode 3 is a zinc anode, and the diode 8 is a Schottky diode, provides an exceptionally effective protection against disbonding of the plastic 11 from the second body 2.

FIG. 7 shows an example of application of an arrangement on a carbon-steel ship 1, on the exterior of which there is a stainless-steel measuring instrument 12 directly connected with a stainless-steel frame 2, which frame 2 is mechanically connected with the ship's skin 1 through an insulating fastening 14. The instrument 12 is sealed such that it is watertight by means of a plastic hood 11 attached to it. The ship's skin 1 is directly connected with a sacrificial anode 3, the stainless-steel frame 2 is connected with the ship's skin 1 through a conductor or electric circuit 6 including two diodes $D_1$ and $D_2$ connected in series. The potential difference between the stainless-steel frame 2 and the ship's skin 1 is adjustable by means of the diodes $D_1$ and $D_2$ and the switches $Sk_1$ and $Sk_2$, according to the conditions, such as the salt content and oxygen content of water 13. Capacitors $C_1$ and $C_2$, which are parallel-connected with the diodes $D_1$ and $D_2$, smoothen possible voltage ripples.

FIG. 8 shows another example of application of the arrangement wherein the reference numbers have the same meaning as in FIG. 7. In deviation from FIG. 7, the ship's skin 1 is connected not directly with the anode 3, but through a line 7 including diodes $D_3$ and $D_4$ which may be short-circuited by switches $Sk_3$ and $Sk_4$ respectively. Finally, this figure shows a measuring electrode 15 connected with a measuring instrument 16, by means of which electrode the "mixed polyelectrode potential" of the galvanic couple made up of the ship's skin 1, stainless-steel frame 2 and anode 3 can be determined, on the basis of which the potential differences of anode 3 and frame 2 with regard to the ship's skin 1 can be adjusted by means of the diodes $D_3$,$D_4$ and $D_1$, $D_2$ respectively, in combination with the associated switches. As to the arrangement shown in FIG. 8, the ease of operation is further augmented when the switches $Sk_1$, $Sk_2$, $Sk_3$ and $Sk_4$ are operated by a measuring and control system 17 coupled to measuring instrument 16.

I claim:

1. An arrangement for cathodic protection from corrosion of at least first and second metal bodies surrounded by an electrolytic medium, comprising:

the first metal body;

the second metal body, with the first body having a lower electric quiescent potential in the electrolytic medium than a quiescent potential of the second body, a metal anode body which has a lower electric quiescent potential in the electrolytic medium than the first body, circuit means for controlling potential difference between at least the first and second metal bodies, wherein the anode body and the bodies to be protected are electrically coupled to one another by said circuit means, said circuit means comprising at least one rectifier device operating above a certain threshold voltage and providing a potential difference between the first and second metal bodies which is at least equal to said threshold voltage but is smaller than the difference in quiescent potential between the first and second bodies.

2. An arrangement as claimed in claim 1, characterized in that the first body is in direct electrical contact with the anode body and the second body is electrically coupled with the first body through a conductor or electric circuit including said at least one rectifier device.

3. An arrangement as claimed in claim 1, characterized in that the first body is coupled with the anode body through a first conductor or electric circuit including a second rectifier device, and the second body is coupled with the first body through a second conductor or electric circuit including said at least one rectifier device.

4. An arrangement as claimed in claim 1, characterized in that the first body is coupled with the anode body through a conductor or electric circuit including said at least one rectifier device and the second body is in direct electrical contact with the anode body.

5. An arrangement as claimed in claim 1, characterized in that the first body is coupled with the anode body through a first conductor or electric circuit including a second rectifier device and the second body is coupled with the anode body through a second conductor or electric circuit including said at least one rectifier device.

6. An arrangement according to any one of claims 1–5, characterized in that said at least one rectifier device is a diode.

7. An arrangement as claimed in claim 6, characterized in that said at least one rectifier device is a Schottky diode whose forward direction corresponds with the difference in the quiescent potential of the bodies coupled through this diode.

8. An arrangement as claimed in claim 1, wherein the first body is made of a carbon steel and the second body is made of a stainless steel, the anode body comprising zinc, characterized in that the first body is in direct electrical contact with the anode body and said circuit means for controlling potential difference comprises a conductor or electric circuit including a Schottky diode whose forward direction corresponds with a difference in quiescent potential of the second and first bodies and said Schottky diode electrically couples the first body to the second body.

9. An arrangement according to claim 1, wherein the first metal body comprises a hull of a vessel and the quiescent potential of the second metal body is different from the quiescent potential of the first metal body.

10. An arrangement according to claim 9, wherein the second metal body comprises a stainless-steel housing and further comprising a plastic attached to the stainless-steel housing so that the plastic is between the stainless-steel housing and the electrolytic medium.

11. An arrangement according to claim 1, wherein said at least one rectifier device comprises at least two diodes and means for connecting the two diodes in series.

12. An arrangement according to claim 1, further comprising a potentiometer comprising an electrode disposed in the electrolytic medium, said potentiometer measuring a mixed polyelectrode potential of a galvanic couple made up of the first metal body, the second metal body, and the metal anode body.

13. An arrangement according to claim 12, wherein said means for controlling comprises an electrical connection between the potentiometer and said at least one rectifier device, and said at least one rectifier device is controlled in accordance with a potential measured by the potentiometer.

14. An arrangement according to claim 4, wherein the electroyltic medium is seawater.

15. An arrangement for cathodic protection from corrosion of at least first and second metal bodies surrounded by an electrolytic medium, comprising:

the first metal body having a quiescent potential in the electrolyte medium;

the second metal body having a quiescent potential in the electrolyte medium;

a metal anode body which has a lower quiescent potential in the electrolytic medium than the quiescent potential of the first body;

wherein the quiescent potential of the first body is lower than the quiescent potential of the second body, the quiescent potential of the second body relative to the anode body is above a voltage level at which disbonding of plastics from the second body occurs;

wherein the first body and the second body are electrically interconnected so that their surfaces are at the same potential; and a circuit means for controlling potential difference between the anode body and the first and second bodies, comprising at least one rectifier device operating above a certain threshold voltage and providing a potential difference between the anode body and the first and second metal bodies, said potential difference is at least equal to said threshold voltage but is smaller than the difference in quiescent potential between the first and second bodies, and is smaller than the voltage level at which disbonding of plastics from the second body occurs.

16. An arrangement according to claim 14, wherein the second body comprises stainless steel.

* * * * *